US009404692B2

(12) United States Patent
Grayson et al.

(10) Patent No.: US 9,404,692 B2
(45) Date of Patent: Aug. 2, 2016

(54) ROTARY THERMAL SWITCH

(75) Inventors: Gary D. Grayson, Huntington Beach, CA (US); Mark W. Henley, Topanga, CA (US)

(73) Assignee: The Boeing Company, Chicago, IL (US)

( * ) Notice: Subject to any disclaimer, the term of this patent is extended or adjusted under 35 U.S.C. 154(b) by 859 days.

(21) Appl. No.: 13/610,865

(22) Filed: Sep. 12, 2012

(65) Prior Publication Data

US 2013/0014928 A1 Jan. 17, 2013

Related U.S. Application Data

(62) Division of application No. 11/767,439, filed on Jun. 22, 2007, now Pat. No. 8,286,696.

(51) Int. Cl.
*F28F 27/00* (2006.01)
*F28F 13/00* (2006.01)

(52) U.S. Cl.
CPC ..... *F28F 13/00* (2013.01); *F28F 2013/008* (2013.01)

(58) Field of Classification Search
CPC ..... F28F 13/00; F28F 2013/008
USPC ..... 165/86, 276, 277
See application file for complete search history.

(56) References Cited

U.S. PATENT DOCUMENTS 3,399,717 A 9/1968 Cline
3,463,224 A 8/1969 Myers
3,502,138 A * 3/1970 Shlosinger ..... F28D 15/06 165/273
3,763,928 A 10/1973 Fletcher
3,957,107 A 5/1976 Altoz
3,999,400 A * 12/1976 Gray ..... F01D 5/088 165/86
4,144,932 A * 3/1979 Voigt ..... H02K 11/042 165/86
4,192,290 A 3/1980 Jensen
4,212,346 A 7/1980 Boyd
4,273,183 A 6/1981 Altoz
4,281,708 A 8/1981 Wing
4,388,965 A 6/1983 Cunningham
4,513,575 A * 4/1985 Dibrell ..... F01B 5/006 165/86
4,513,576 A * 4/1985 Dibrell ..... F04B 47/028 165/86
4,520,632 A * 6/1985 Dibrell ..... F01B 5/006 165/86
4,727,932 A * 3/1988 Mahefkey ..... B64G 1/50 165/86

(Continued)

OTHER PUBLICATIONS

Marland,"Development and testing of an advanced cryogenic thermal switch and cryogenic thermal switch test bed," Cryogenics 44, 2004, pp. 413-420.

*Primary Examiner* — Ljiljana Ciric

(57) ABSTRACT

An method of controlling thermal transfer between a first structure and a second structure may include a signal at a thermal switch. In response to receiving the signal at the thermal switch, a rotating plate may be rotated into one or more positions adjacent to a fixed plate to facilitate radiative thermal transfer between the rotating plate and the fixed plate. The rotating plate and the fixed plate may be in thermally conductive contact with respective ones of the first structure and the second structure.

12 Claims, 6 Drawing Sheets

(56) References Cited

U.S. PATENT DOCUMENTS 4,842,045 A * 6/1989 Reinmuller ..... B64G 1/503 165/41
5,123,479 A * 6/1992 Pravda ..... F28D 15/0208 165/86
5,281,516 A * 1/1994 Stapleton ..... B01L 7/52 165/86
RE35,716 E * 1/1998 Stapleton ..... B01L 7/52 165/86
5,718,282 A * 2/1998 Bhatia ..... G06F 1/203 165/86
5,732,765 A * 3/1998 Drolen ..... B64G 1/50 165/86
5,910,883 A * 6/1999 Cipolla ..... F28D 15/0233 165/86
6,050,333 A * 4/2000 Albaroudi ..... F28D 11/025 165/86
6,119,463 A * 9/2000 Bell ..... B60H 1/00471 165/86
6,276,144 B1 8/2001 Marland
7,411,792 B2 8/2008 Richards
7,701,716 B2 * 4/2010 Blanco, Jr. ..... F28D 15/0275 165/86
7,882,891 B2 2/2011 Kuriyama
8,182,096 B2 * 5/2012 Kiser ..... G03B 21/16 165/86
8,286,696 B2 * 10/2012 Grayson ..... F28F 13/00 165/276
8,978,747 B2 * 3/2015 Peterson ..... H05K 7/20745 165/86
2003/0042007 A1 * 3/2003 Sandu ..... F28D 7/106 165/86
2009/0223648 A1 * 9/2009 Martin ..... F28F 1/40 165/86
2010/0025022 A1 * 2/2010 Tien ..... G06F 1/20 165/276

* cited by examiner

ROTARY THERMAL SWITCH

CROSS-REFERENCE TO RELATED APPLICATIONS

The present application is a divisional application of and claims priority to pending U.S. application Ser. No. 11/767,439 filed on Jun. 22, 2007 and entitled MECHANICALLY ACTUATED THERMAL SWITCH, the entire contents of which is expressly incorporated by reference herein.

GOVERNMENT LICENSE RIGHTS

The U.S. Government has a paid-up license and the right in limited circumstances to require the patent owner to license others on reasonable terms as provided for by the terms of Contract No. NNM05AA97C awarded by the National Aeronautics and Space Administration.

FIELD

Embodiments of the disclosure relate to thermal switches, specifically switches for transferring heat and/or tuning the rate of heat transfer between two structures on command.

BACKGROUND

There are many thermal switching means to transfer heat between structures, such as in cryogenic refrigeration systems, also known as cryocoolers. These means are passive and operate by isolating the cryocooler and associated hardware from outside heat leaks. These devices depend on principles of thermal expansion of materials to create or tear down a thermally conductive path between structures. Thus, when a desired temperature is reached, a conductive material either expands or contracts thereby connecting or isolating a structure to be cooled or heated.

A significant limitation of these thermal switches is that they can not initiate thermal transfer on command or be tuned to control the rate of thermal transfer. For a system in which the desired thermal transfer between structures in the system is not known when the system is designed or manufactured, these types of thermal switching means will not work. Also, because these thermal switches can not be commanded to initiate or suspend thermal transfer, or be dynamically tuned to alter the rate of thermal transfer, these switches will not work in an environment or system where the thermal transfer or flow requirements between elements may change over time.

SUMMARY

Embodiments of the present invention solve the problem of initiating and/or varying heat transfer between two structures on command. In a Thermally-Integrated Fluid Storage and Pressurization System, heat may need to be moved advantageously between cryogenic liquid tanks, supercritical fluids bottles, rocket engines, spacecraft structures, and other devices. These components may be physically separated and require heat to be transferred in an efficient manner. Also, the desired thermal transfer characteristics may change depending on the operation of the system. For example, it may be necessary or advantageous to raise the temperature of a structure at one time to a first temperature, and to lower the temperature of the same structure at another time to a second temperature either higher or lower than the first temperature. Alternatively, it may be necessary and/or advantageous to transfer heat between the structures rather than separately cooling one structure and heating another to allow the system to be more energy efficient. Thus, embodiments of the present invention can be practiced to initiate thermal transfer on command and/or tune the rate of heat transfer between two structures.

Various embodiments of the present invention may involve methods of causing, in response to a signal, a first one or more thermally conductive members in thermal-conductive contact with a first structure to be placed within sufficient proximity to one or more thermally conductive members in thermal-conductive contact with a second structure. Thus, thermal transfer may be advantageously commanded.

In various embodiments, methods may include moving the first one or more thermally conductive members to be placed within a sufficient proximity to the second one or more members to facilitate a selected radiative thermal transfer rate between the first and second structures via the first and second one or more thermally conductive members. Radiative thermal transfer may be slower than other forms of thermal transfer such as, for example, conductive thermal transfer. Therefore, depending on a desired rate of thermal conductivity, radiative thermal transfer may be advantageous.

In various embodiments, the positioning of the first one or more thermally conductive members may cause the first one or more members to make physical contact with either the second one or more thermally conductive members or a third one or more thermally conductive members attached to the second structure thereby facilitating a thermally conductive transfer between the first and second structures. Conductive thermal transfer may be faster than, for example, radiative thermal transfer. Therefore, depending on a desired rate of thermal conductivity, conductive thermal transfer may be advantageous.

In various embodiments, adjusting the position of the first one or more members may advantageously increase or decrease a selected rate of radiative thermal transfer between the first and second structures.

In various embodiments, the adjacent positioning of the first and second one or more thermally conductive members may cause a portion of the surface area of the first one or more members to make physical contact with the second one or more members and advantageously open a thermally conductive path between the first and second structures.

In various embodiments, the thermally conductive members may be translating plates and a gear-driven electric motor of the thermal switch may translate a rotational motive force into a linear motion of the translating plates by acting on a plurality of gear teeth of the translating plates.

In various embodiments, the first one or more thermally conductive members may be rotating plates operatively coupled to a gear-driven electric motor of the thermal switch, and the electric motor may advantageously cause the plates to rotate.

In various embodiments, the second one or more members may be fixed plates, and adjusting the angle of the rotating plates to a selected angle may advantageously achieve the selected rate of thermal transfer by varying the surface area of the rotating plates that are in proximity to the fixed plates. The rate of radiative thermal transfer may be directly correlated to this surface area.

Embodiments of the invention may be a thermal switch for transferring thermal energy between a first and a second structure having a casing with a travel slot and an opening aligned with the travel slot. A thermally conductive member may be disposed at least partially within the travel slot and an actuator may provide a motive force to the thermally conductive member to move the thermally conductive member along the travel slot and extend the thermally conductive member a pre-determined length out of the opening of the casing, thus facilitating thermal transfer when the thermally conductive member is thermally conductively connected to a first structure and it is placed within proximity to a second structure.

In various embodiments, the thermally conductive member may be a translating plate having an end section adapted to fit into, and make physical contact with, a corresponding section of a contact plate attached to the second structure. Thus, the surface area of the thermally conductive member that forms the conductive path may be increased. Also, small alignment issues of the thermally conductive member may be advantageously resolved by providing a corresponding section for the member to slide into.

In various embodiments, the actuator is a gear-driven electric motor and the translating plate further may have a plurality of gear teeth adapted to fit a corresponding plurality of teeth of the gear-driven electric motor and a rotational motive force of the electric motor may be translated into a linear motion of the translating plate by an action of the plurality of teeth of the motor against the plurality of gear teeth.

In various embodiments, an electric solenoid actuator may provide a motive force for the thermally conductive member.

In various embodiments, the thermally conductive member may be coupled to the casing of the switch via a thermally conductive and flexible ribbon or wire thereby advantageously facilitating a thermal conduction path between the first and second structure when the thermally conductive member is extended and in contact with the contact plate.

Various embodiments of the present invention may include thermal switches for transferring thermal energy between a first and a second structure with a cover comprising an opening. The switch may be adapted to be attached to the first structure and an actuator may be disposed within the cover. In embodiments, at least one thermally conductive rotating member may be operatively coupled to the actuator, and may be rotatable by the actuator to a selected one of a plurality of angles such that, when rotated to a selected angle, it may be rotated out of the casing and positioned proximate to at least one thermally conductive fixed member that may be thermal-conductively coupled to the second structure thereby advantageously facilitating a radiative thermal transfer between the first and second structures.

In various embodiments, the actuator may be operated to rotate the rotating member to the selected one of a plurality of angles in order to advantageously control the rate of radiative thermal transfer.

In various embodiments, the rotating plate(s) may be further adapted to be rotatable so that it contacts a thermally conductive stop attached to the second structure, thereby advantageously facilitating a conductive thermal transfer between the first and second structures in addition to the radiative thermal transfer.

In various embodiments, switches may be adapted for use in zero gravity conditions and in vacuum and/or near-vacuum conditions. Thus, embodiments of the invention may be advantageously used in man-made orbiting spacecraft.

The features, functions, and advantages can be achieved independently in various embodiments of the present inventions or may be combined in yet other embodiments.

BRIEF DESCRIPTION OF THE DRAWINGS

Embodiments of the disclosure will be readily understood by the following detailed description in conjunction with the accompanying drawings. Embodiments of the disclosure are illustrated by way of example and not by way of limitation in the figures of the accompanying drawings.

DETAILED DESCRIPTION

In the following detailed description, reference is made to the accompanying drawings which form a part hereof and in which is shown, by way of illustration, embodiments of the disclosure. It is to be understood that other embodiments may be utilized and structural or logical changes may be made without departing from the scope of the disclosure. Therefore, the following detailed description is not to be taken in a limiting sense, and the scope of embodiments in accordance with the disclosure is defined by the appended claims and their equivalents.

Various operations may be described as multiple discrete operations in turn, in a manner that may be helpful in understanding various embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of the embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" means A or B. For the purposes of the description, a phrase in the form "A and/or B" means "(A), (B), or (A and B)." For the purposes of the description, a phrase in the form "at least one of A, B, and C" means "(A), (B), (C), (A and B), (A and C), (B and C), or (A, B and C)." For the purposes of the description, a phrase in the form "(A)B" means "(B) or (AB)," that is, A is an optional element.

The description may use the phrases, "various embodiments," "in an embodiment," or "in embodiments," which may each refer to one or more of the same or different embodiments. Furthermore, the terms "comprising," "including," "having," and the like, as used with respect to embodiments as described in the present disclosure, are synonymous.

Figure 1:
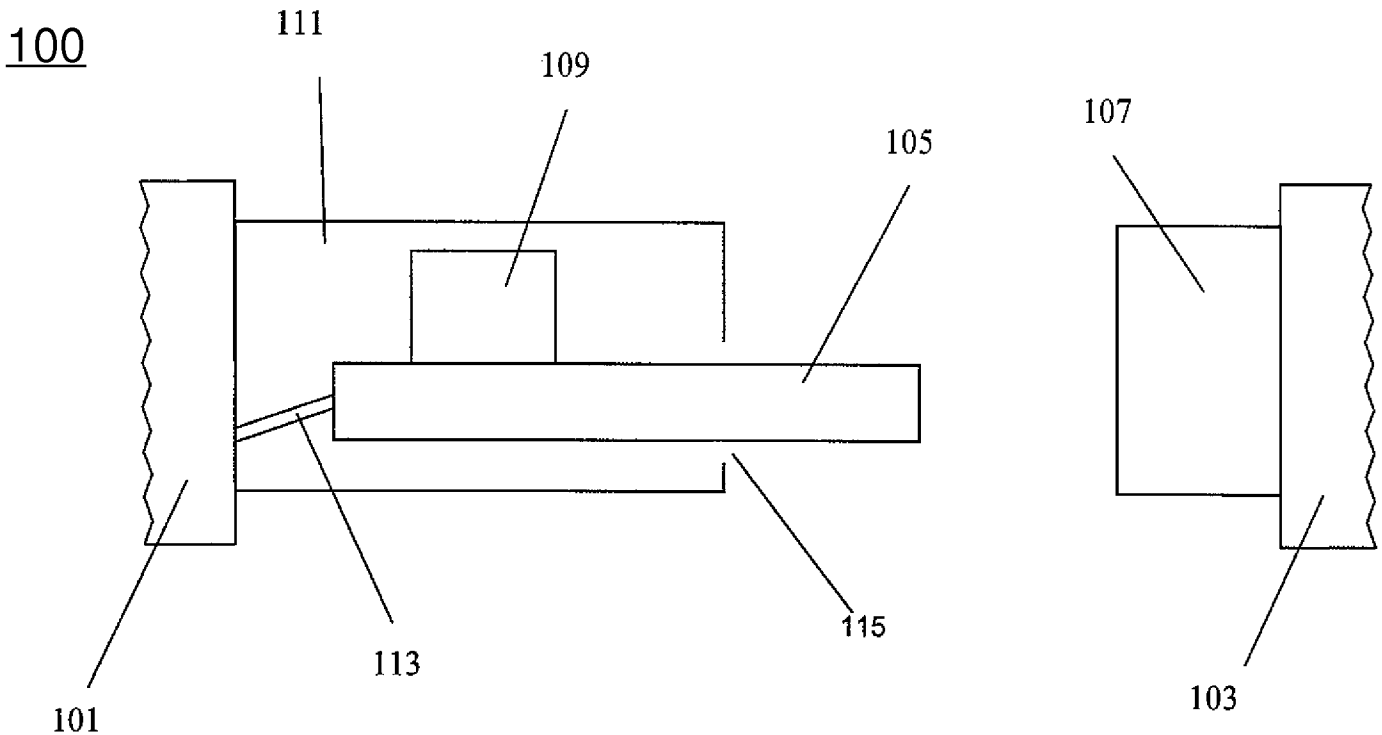
FIG. 1 depicts a block diagram of a thermal switch device for transferring thermal energy between two structures in accordance with various embodiments of the present invention.

FIG. 1 depicts a block diagram of a thermal switch 100 for transferring heat between first structure 101 and second structure 103 in accordance with various embodiments. First thermally conductive member 105 may be thermally coupled to first structure 101 through, for example, flexible conductive element 113. Second thermally conductive member 107 may be coupled or connected to second structure 103. An actuator 109 disposed within housing 111 may be adapted to move first thermally conductive member 105 towards second thermally conductive member 107 through opening 115. In embodiments, first thermally conductive member 105 may be adapted to be positioned adjacent to, but not in physical contact with, second thermally conductive member 107. In that case, the thermal switch of FIG. 1 may facilitate a radiative thermal transfer between first structure 101 and second structure 103.

In other embodiments, first thermally conductive member 105 may be positioned such that it physically contacts second thermally conductive member 107 facilitating a conductive thermal transfer between first structure 101 and second structure 103.

In embodiments, first and second thermally conductive members 105 and 107 may be a translating plate and an opposing contact plate, respectively. In embodiments, a translating plate may have a shaped feature at its distal end that fits into a corresponding shaped feature of a contact element which may, in embodiments, correct any misalignment of the travel path of the translating plate and increase the surface area of contact between the two plates to increase conductive thermal transfer. Such shaped features may be, for example, a wedge or other shape. In embodiments, actuator 109 may provide linear motion to first thermally conductive member 105. In embodiments, first and second thermally conductive members 105 and 107 may be a rotating plate and a fixed plate, respectively. In those embodiments, actuator 109 may act to rotate the rotating plate to place it into a position adjacent to the fixed plates to facilitate radiative thermal transfer. In embodiments, a linear translating plate may be used to facilitate radiative thermal transfer.

In embodiments, actuator 109 may be a gear-driven electric motor or a solenoid actuator or other actuators known in the art. In embodiments, gears of a gear-driven electric motor may be made of materials that have low thermal transfer characteristics thereby minimizing thermal transfer between thermally conductive member 105 and actuator 109. In embodiments, actuator 109 may generate rotational motion. In embodiments, actuator 109 may generate rotational motion which may be translated into linear motion of first thermally conductive member 105. In embodiments, conductive element 113 may be a flexible and thermally conductive wire, ribbon, or other implement. In embodiments, the various conductive elements may be composed of materials suitable for thermal conduction and/or radiation such as, for example, metallic materials known in the art and/or composite materials, as well as other suitable thermally conductive materials. One of ordinary skill in the art will recognize that embodiments of the present invention are not limited to any particular material or materials.

Figure 2:
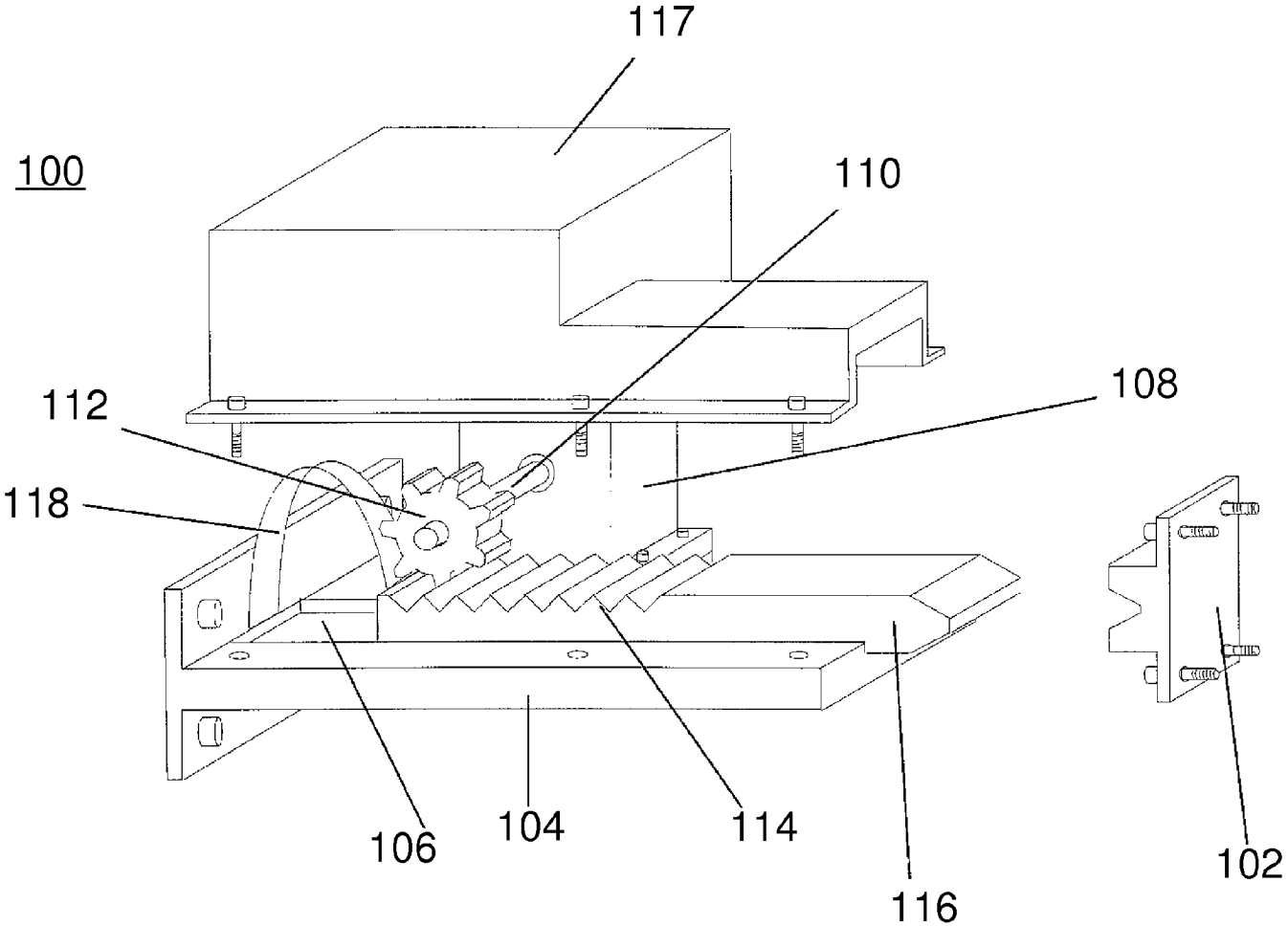
FIG. 2 depicts an exploded view of a thermal switch utilizing a translating plate in accordance with various embodiments.

FIG. 2 depicts an exploded view of thermal switch 100 utilizing a translating plate 116 in accordance with various embodiments of the present invention. Translating plate 116 may be adapted to move within travel slot 106 of base plate 104. Also, conductive ribbon 118 may assist translating plate 116 in maintaining thermally conductive contact with the thermal switch 100. In embodiments, conductive ribbon 118 may be replaced with a conductive wire. Base plate 104 may be in contact with a first structure (not shown). In this way, thermal switch 100 may be in thermally conductive contact with the first structure. In other embodiments, thermal switch 100 may utilize a conductive ribbon or wire to make contact with the first structure. In still other embodiments, thermal switch 100 may be adjacent to the first structure with features (not shown) adapted to radiate heat to and from the first structure.

Electric motor 108 may comprise drive shaft 110 connected to gear 112. Rotational motion generated by electric motor 108 may be translated into linear motion of translating plate 116 by the motion of gear 112 acting on the plurality of gear teeth 114 of translating plate 116. Translating plate 116 may then be moved along travel slot 106 and into contact with contact plate 102 attached to a second structure (not shown), thus facilitating a thermal conduction path between the first structure and second structure when translating plate 116 has been moved into contact with contact plate 102. An end region of translating plate 116 may be adapted to fit into a correspondingly shaped region of contact plate 102 to facilitate the alignment of translating plate 116 with contact plate 102 and to increase the total surface area of translating plate 116 that contacts contact plate 102 thereby increasing the rate of thermal transfer. As shown in FIG. 2, the end region of translating plate 116 may be wedge-shaped, but one of ordinary skill in the art would appreciate that other shapes may also be used. Cover 117 may be disposed on top of base plate 104 and cover the various components of thermal switch 100. In embodiments, gear 112 and drive shaft 110 may be made of materials with low thermal conductivity properties to minimize heat transfer to electric motor 108. Electric motor 108 may be selected to operate in the expected temperature conditions. In embodiments, thermal switch 100 may be adapted to operate in both vacuum conditions and atmospheric conditions.

Figure 3A:
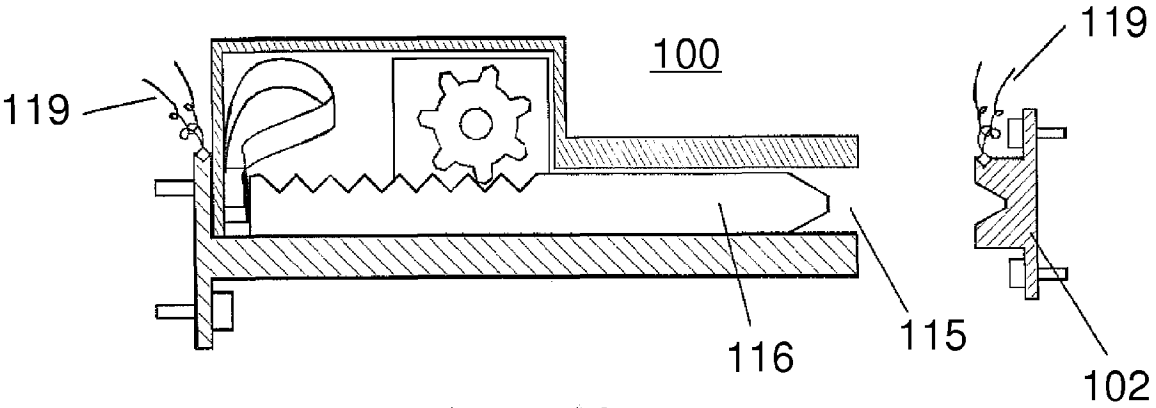
FIGS. 3A and 3B depict side views of a thermal switch utilizing a translating plate with gear teeth in an open position for little or no heat transfer and a closed position for high conductive heat transfer, respectively.
Figure 3B:
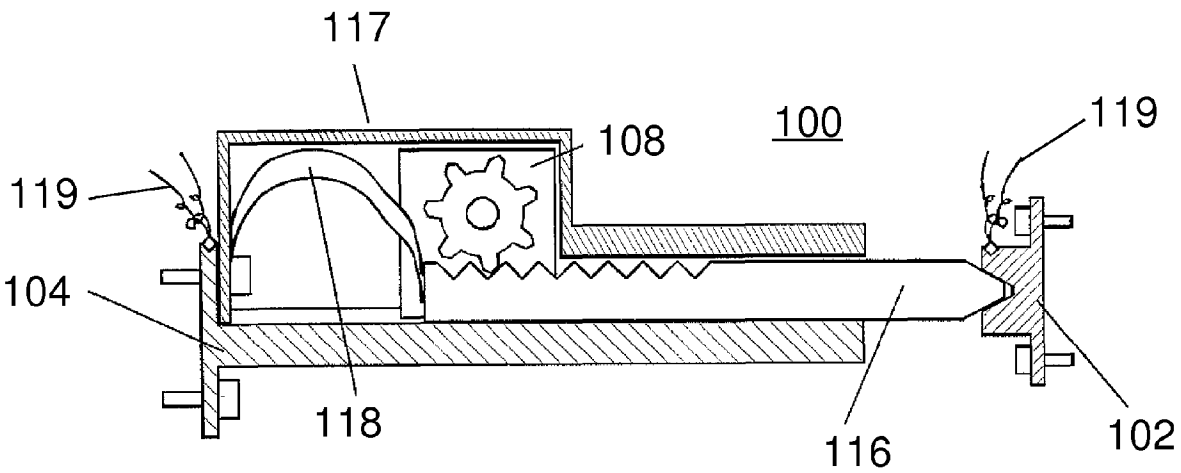

FIGS. 3A and 3B depict a side view of thermal switch 100 in accordance with various embodiments. FIG. 3A depicts thermal switch 100 in an open position with translating plate 116 completely retracted inside thermal switch 100. In this position, there may be little or no heat transfer between a first structure (not shown) attached to thermal switch 100 and a second structure (not shown) attached to contact plate 102. In the vacuum conditions of space, only radiative thermal transfer may occur between translating plate 116 and contact plate 102 which may be minimal in the configuration shown. In embodiments, a hinged flap or other cover (not shown) may be placed over opening 115 that may open when translating plate 116 moves through opening 115. In embodiments, the flap may be made of material with low thermal conductivity, thereby minimizing the radiative heat loss out of opening 115. A radiative thermal transfer rate of the open system shown in FIG. 3A may, in any event, be much smaller than the conductive thermal transfer rate achieved when thermal switch 100 is in the closed position (shown in FIG. 3B). In an atmospheric environment, a convective heat transfer rate between translating plate 116 and contact plate 102 may occur which may be greater than the radiative heat transfer rate that may occur in vacuum-like conditions.

Also shown are temperature sensors 119 which may facilitate monitoring and operation of thermal switch 100.

FIG. 3B depicts thermal switch 100 in a closed position with translating plate 116 having been moved into contact with contact plate 102. Motor 108 may be energized on command to move translating plate 116 down a travel slot (not shown). Thus, a thermally conductive path may be created between the first and second structure (not shown). Heat may flow to or from the first structure into thermal switch 100, to translating plate 116 via conductive ribbon 118 and, in some embodiments, base plate 104. Heat may then flow to or from translating plate 116 into contact plate 102 as the two are now in thermal conductive contact. From there, heat may flow into or out of the second structure. In embodiments, the wedge-shaped end of translating plate 116 may not be as deep as the corresponding wedge-shaped feature of contact plate 102. In this way, the contact area of translating plate 116 may contact the contact area of contact plate 102 before reaching the end of its range of motion. In embodiments, this may ensure sufficient contact area to facilitate thermal conduction. When heat transfer is no longer desired, motor 108 may be adapted to be energized and spun in reverse causing translating plate 116 to travel back down the travel slot and be fully retracted inside thermal switch 100.

In embodiments, closed loop motor control using sensors (not shown) or other instruments may be optionally included to turn off motor 108 once thermal switch 100 is fully open or fully closed. Alternatively, an open-loop timed approach may be used to control motor input power. Also, a latching mechanism may be added to prevent motor 108 from moving once power is removed.

Figure 4:
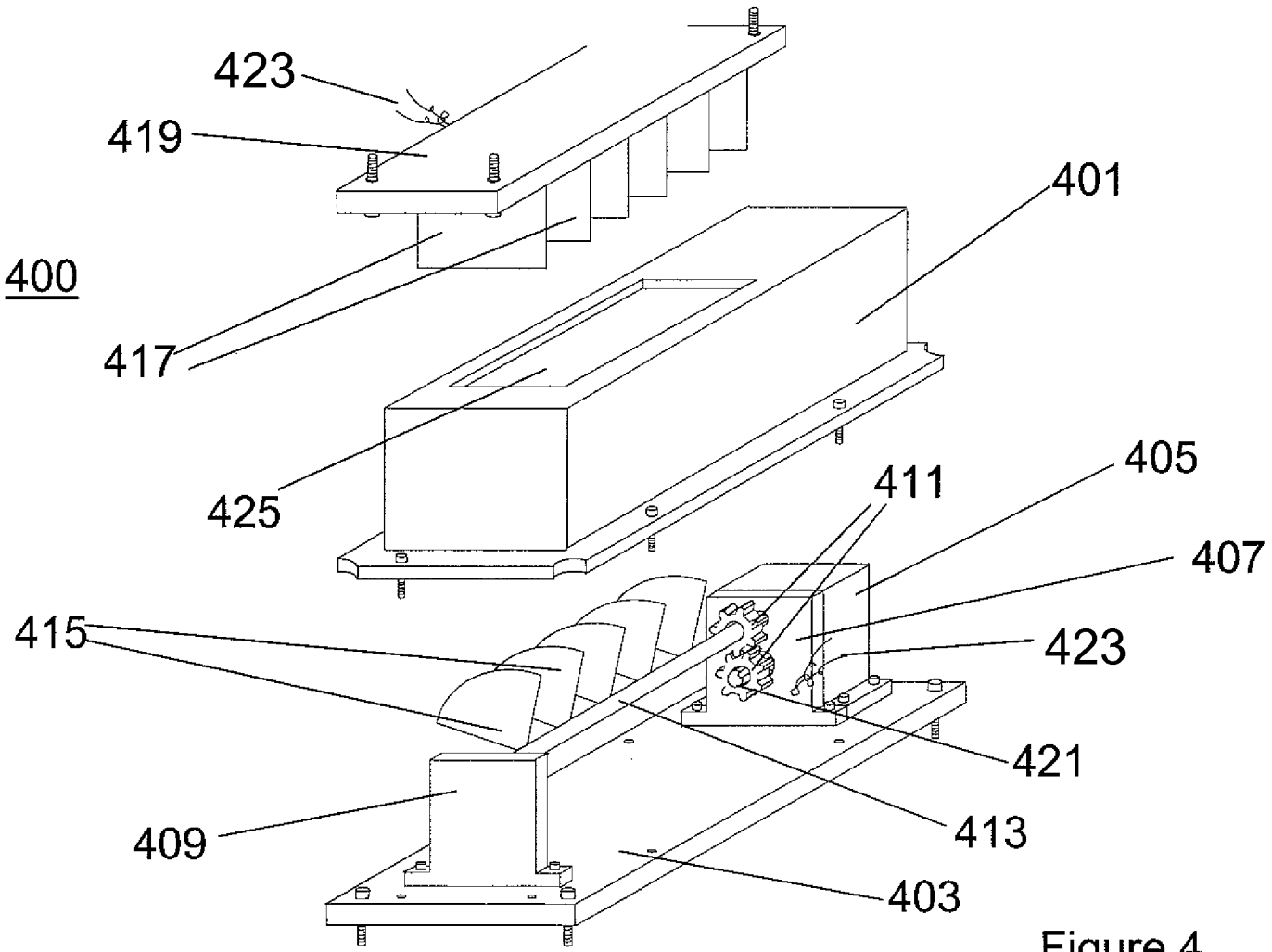
FIG. 4 depicts an exploded view of a thermal switch utilizing rotating plates for providing either conductive or radiative thermal transfer.

FIG. 4 depicts an exploded view of tunable thermal switch 400 in accordance with various embodiments. Cover 401 may be attached to base plate 403 when thermal switch 400 is constructed. Active base plate 403 may have attached to it electric motor 405, inner shaft support 407, outer shaft support 409 as well as other components. Connected to electric motor 405 may be drive shaft 421. Gears 411 may be adapted to translate rotational motion of electric motor 405 to axle 413 which may be attached to a plurality of parallel rotating plates 415.

Rotating plates 415 may be adapted to be rotated through cover opening 425 and into the gaps in between the plurality of parallel fixed plates 417 thus interleaving rotating plates 415 with fixed plates 417 without making contact. This may allow radiative thermal transfer between rotating plates 415 and fixed plates 417. The resistance to thermal transfer between the two sets of plates, and thus the rate of radiative thermal transfer between them, may depend on the radiative view factor achieved by the angle of rotation of rotating plates 415. The radiative view factor may depend, among other things, on the surface area of each of rotating plates 415 that has been rotated into the gaps between fixed plates 417. This surface area is determined by the angle of rotation of rotating plates 415. Thus, by varying the angle of rotation of rotating plates 415, and thereby varying the surface area of rotating plates 415 that are within the gaps between fixed plates 417, the rate of thermal transfer between rotating plates 415 and fixed plates 417 may be selected by an operator of thermal switch 400.

In embodiments, active base plate 403 may be adapted to be attached to a first structure (not shown) in a way as to provide for conductive heat transfer between the first structure and thermal switch 400. Also, fixed plates 417 may be adapted to be attached to passive base plate 419 which may be adapted to be attached to a second structure (not shown). In this way, conductive thermal transfer between the second structure and fixed plates 417 may occur. Thus, when rotating plates 415 are rotated and interleaved with fixed plates 417, the radiative thermal transfer between them may open a thermal transfer path between the first and second structures. Also, in embodiments, varying the angle of rotation of rotating plates 415, and thus the radiative view factor, a desired rate of thermal transfer between the first and second structures may be achieved.

Additionally, rotating plates 415 may be adapted to be rotated to a maximum angle and contact a thermally conductive stop (not shown) attached to passive base plate 419. Thus, depending on the angle of rotation of rotating plates 415, thermal conduction may be facilitated in addition to the radiative thermal transfer.

In embodiments, active base plate 403, passive base plate 419, rotating plates 415, fixed plates 417, axle 413, conductive stop block (not shown), outer shaft support 409, and inner shaft support 407 may be made from materials with high thermal conductivity characteristics. These materials may be metallic or any high conductivity material. In embodiments, cover 401, drive shaft 421, and gears 411 may be made of low conductivity materials to minimize thermal transfer to electric motor 405. Parallel rotating plates 415 may be welded to axle 413 to maximize conductive heat transfer between rotating plates 415 and axle 415, outer shaft support 409, and inner shaft support 407.

In embodiments, rotating plates 415 may be quarter circle shape, as shown in FIG. 4, which may allow them to be fully retracted into cover 401. One of ordinary skill will recognize that rotating plates 415 may be other shapes including circular segments that are more or less than a quarter circle. In embodiments, there may only be one rotating plate and one fixed plate. In embodiments, there may be one rotating plate and two fixed plates. In embodiments there may be two rotating plates and one fixed plate. In embodiments, there may be a plurality of both rotating plates 415 and fixed plates 417 as shown in FIG. 4. One of ordinary skill in the art will recognize that any number of plates of both types may be selected based on the desired operating characteristics of thermal switch 400. In alternative embodiments of the present invention, one or more translating plates, rather than rotating plates, may be moved into an interleaved fashion with one or more base plates. In these embodiments, the degree of overlap between the two sets of plates may allow the rate of radiative thermal transfer to be tunable.

In embodiments, fixed plates 417 may be welded to passive plate 419 to maximize thermal transfer. Fixed plates 417 may be, as shown in FIG. 4, rectangular with a 2:1 length-to-width ratio; however, other shapes and/or ratios may be selected as desired. Fasteners may be used to attach active base plate 403 and passive base plate 419 to structures as desired to promote conductive thermal transfer. Also, two temperature sensors 423 may be included to monitor temperature. In embodiments, more than two temperature sensors may be included to improve or alter the monitoring capabilities. In embodiments, one or no temperature sensors may be included.

In embodiments, closed loop motor control using limit sensors (not shown) or other instruments may be used to turn motor 405 off once thermal switch 400 is fully open or fully closed. In alternative embodiments, an open loop timed approach may be used to control motor input power. In embodiments, a latching mechanism (not shown) may be used to prevent motor 405 from moving once power is removed.

Figure 5B:
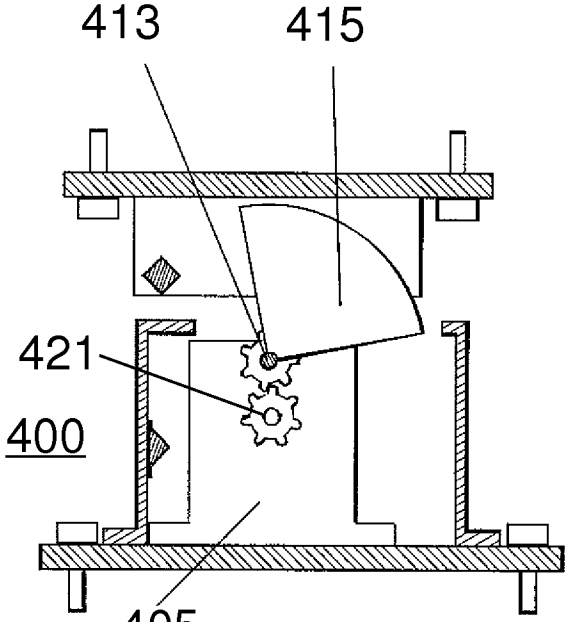
FIGS. 5A, 5B, and 5C depict side views of a thermal switch utilizing rotating plates in an open position with little or no heat transfer, a partially rotated position for a variable radiative heat transfer, and a closed position for conductive heat transfer, respectively.
Figure 5A:
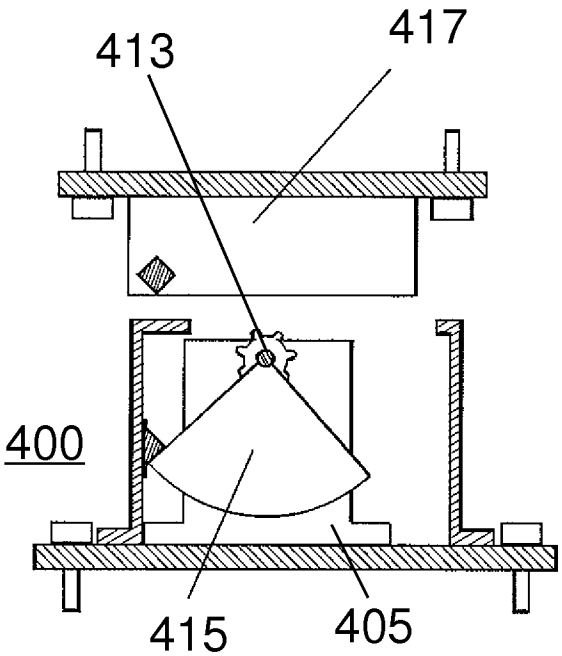
Figure 5C:
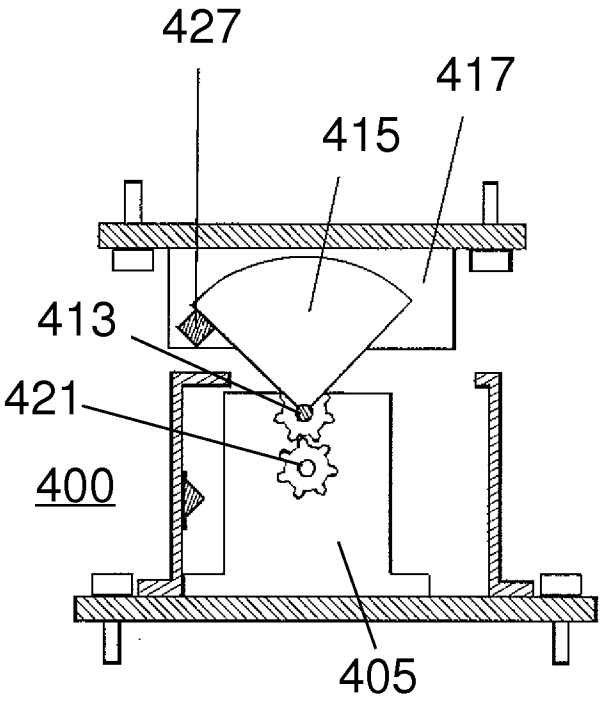

FIGS. 5A-C depict a side view of tunable thermal switch 400 in accordance with various embodiments. FIG. 5A shows thermal switch 400 in an open position with little or no heat transfer. Rotating plate 415 is shown rotated as far away as possible from fixed plate 417. In this position, radiative thermal transfer rate is minimized. FIG. 5B shows tunable thermal switch 400 in a position with a moderate radiative thermal transfer rate. The angle of rotating plate 415 may be adjusted by energizing electric motor 405 and rotating drive shaft 421 to the desired angle. Therefore, the angle of rotation of rotating plate 415 may be adjusted to tune thermal switch 400 to a desired level of radiative thermal transfer by increasing or decreasing the radiative view factor as discussed above.

In this way, the overall thermal transfer rate may between the first and second structures (not shown) may be tuned by an operator of thermal switch 400.

FIG. 5C depicts thermal switch 400 in a closed position with conductive and radiative thermal transfer. Here, rotating plate 415 has been rotated to a maximum angle thereby maximizing the radiative view factor between rotating plate 415 and fixed plate 417. Also, rotating plate 415 may be adapted to contact conductive stop block 427 in order to facilitate conductive heat transfer which may, in embodiments, be a greater rate of thermal transfer than radiative heat transfer. Thus, tunable switch 400 may be tuned to a maximum rate of thermal transfer.

In embodiments, radiative heat transfer may perform best in the vacuum conditions of space as there is negligible gas present to permit convection between rotating plates 415 and fixed plates 417. When thermal switch 400 is used in these conditions, a greater difference in heat transfer characteristics may be observed between the open and closed positions compared with the same switch used in atmospheric environments.

Thus, tunable thermal switch 400 may provide, in accordance with various embodiments, a variable resistance to heat transfer that may be tuned to achieve a desired radiative thermal transfer rate and be adapted to be activated on command. Also, tunable switch 400 may be activated, according to some embodiments, to achieve conductive thermal transfer.

Although certain embodiments have been illustrated and described herein for purposes of description of the preferred embodiment, it will be appreciated by those of ordinary skill in the art that a wide variety of alternate and/or equivalent embodiments or implementations calculated to achieve the same purposes may be substituted for the embodiments shown and described without departing from the scope of the disclosure. Those with skill in the art will readily appreciate that embodiments in accordance with the present disclosure may be implemented in a very wide variety of ways. This application is intended to cover any adaptations or variations of the embodiments discussed herein. Therefore, it is manifestly intended that embodiments in accordance with the present disclosure be limited only by the claims and the equivalents thereof.

What is claimed is:

1. A method of controlling thermal transfer between a first structure and a second structure, comprising the steps of:

receiving a signal at a thermal switch having an actuator, at least one rotating plate, and at least one fixed plate, the rotating plate and the fixed plate being in thermally conductive contact with respective ones of a first structure and a second structure, the thermal switch including a cover attached to the first structure, the cover at least partially enclosing the rotating plate and having an opening; and rotating, in response to the thermal switch receiving the signal, the rotating plate out of the opening of the cover and into one or more positions adjacent to the fixed plate to facilitate radiative thermal transfer between the rotating plate and the fixed plate.

2. The method of claim 1 wherein the step of rotating comprises:

rotating the rotating plate using a gear-driven electric motor of the thermal switch.

3. The method of claim 1 wherein the step of rotating comprises:

adjusting an angle of rotation of the rotating plate by energizing an electric motor and rotating a drive shaft coupled to the rotating plate.

4. The method of claim 1 further comprising the step of:

adjusting the angle of rotation of the rotating plate to time the thermal switch to a desired level of radiative thermal transfer.

5. The method of claim 1 wherein the thermal switch includes a conductive stop block attached to the second structure, the method further comprising the steps of:

rotating the rotating plate into contact with the conductive stop block; and conductively transferring heat between the rotating plate and the conductive stop block.

6. The method of claim 5 wherein the step of rotating the rotating plate into contact with the conductive stop block comprises:

rotating the rotating plate from an open position to a closed position with conductive and radiative thermal transfer between the rotating plate and the conductive stop block.

7. A thermal switch for transferring thermal energy between a first structure and a second structure, comprising:

a cover having an opening and being attached to the first structure;

an actuator disposed within the cover;

a thermally conductive rotating plate operatively coupled to the actuator and being rotatable by the actuator at least partially out of the opening and into one or more positions adjacent to a fixed plate to facilitate radiative thermal transfer between the rotating plate and the fixed plate; and the rotating plate and the fixed plate being in thermally conductive contact with respective ones of the first structure and the second structure.

8. The thermal switch of claim 7 wherein:

the actuator is operable to rotate the rotating plate into one of a plurality of angles relative to the fixed plate.

9. The thermal switch of claim 7 wherein:

the rotating plate is rotatable into contact with a thermally conductive stop attached to the second structure, thereby facilitating a conductive thermal transfer between the first and second structures.

10. The thermal switch of claim 9 wherein:

the rotating plate is rotatable from an open position with relatively minimal radiative thermal transfer between the rotating plate and the fixed plate, to a closed position with conductive thermal transfer and radiative thermal transfer between the rotating plate and the conductive stop block.

11. The thermal switch of claim 7 wherein:

the actuator comprises a gear-driven electric motor.

12. The thermal switch of claim 11 wherein:

the rotating plate is coupled to a drive shaft of the electric motor.

* * * * *